US007212165B2

(12) United States Patent
Yang et al.

(10) Patent No.: US 7,212,165 B2
(45) Date of Patent: May 1, 2007

(54) CHIP ANTENNA

(75) Inventors: Chang-Fa Yang, Hsinchuang (TW); Jen-Hsun Li, Taipei (TW); Jing-Ming Chen, Taichung Hsien (TW); Jun-Hong Lin, San Chung (TW); Shun-Tian Lin, Hsi Chih (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 10/960,310

(22) Filed: Oct. 6, 2004

(65) Prior Publication Data

US 2005/0104787 A1 May 19, 2005

(30) Foreign Application Priority Data

Nov. 19, 2003 (TW) ..... 92132453 A

(51) Int. Cl.
*H01Q 1/24* (2006.01)

(52) U.S. Cl. ..... 343/702; 343/895

(58) Field of Classification Search ..... 343/895, 343/700 MS, 702
See application file for complete search history.

(56) References Cited

U.S. PATENT DOCUMENTS

2002/0089456 A1* 7/2002 Hamada ..... 343/702
2002/0133293 A1* 9/2002 Goldman ..... 701/213

* cited by examiner

*Primary Examiner*—Tho Phan
(74) *Attorney, Agent, or Firm*—Michael A. Glenn; Glenn Patent Group

(57) ABSTRACT

A chip antenna has an antenna body and a package. The antenna body has multiple meandered metal lines and is encapsulated with the package. The material of the package is a dielectric composite formed with polymers and ceramic powders, which has a dielectric constant designed for the antenna. The characteristics of the chip antenna are determined by the structures of the antenna body and the dielectric constant of the package. Thus, a requirement for tiny structures in antenna applications can be satisfied.

6 Claims, 9 Drawing Sheets

CHIP ANTENNA

RELATED APPLICATIONS

The present application is based on, and claims priority from, Taiwan Application Serial Number 92132453, filed Nov. 19, 2003, the disclosure of which is hereby incorporated by reference herein in its entirety.

BACKGROUND

1. Field of Invention

The present invention relates to an antenna. More particularly, the present invention relates to a chip antenna.

2. Description of Related Art

Many modern electronic devices, such as mobile telephones, computers, and network devices, are all provided with functions that communicate signals by wireless communications, following the great progress of the wireless communication science and technology. The main emitting and receiving devices used in wireless communication are signal transceivers and antennas configured thereon. Due to the modern electronic devices becoming lightweight, and small and thin in size, conventional antennas, like rod antennas, Yaki antennas, dish antennas and so on, no longer fill the characteristic requirements of new generation.

Hence, a chip antenna is developed, which has meandered lines and a ceramic material with a designed dielectric constant, to miniaturize the size of the antenna. The chip antenna gradually becomes an indispensable element used in a communication product because of its small size and being directly and easily installed in the electronic devices. But the conventional chip antenna still has some drawbacks, such as a slightly large size, insufficient efficiency, and high manufacturing cost.

The following descriptions uses several related patents to explain what drawbacks or functional imperfections exist in the prior circuit design or manufacturing processes of the conventional chip antenna.

1. Taiwan Patent No. 479852:

The patent discloses a chip antenna, which forms a conductive metal line on a tiny ceramic substrate following the design principle of microline antennas, to minimize the size and volume of the conductive metal line by the high dielectric constant of the ceramic substrate. The conductive metal line is just a flat conductive line with one single input port, not a complete antenna, which needs to associate with an external circuit to work. For example, the chip antenna needs to be installed on a circuit board and associated with an external circuit on the circuit board, thus functioning as an antenna, and the external circuit can be used to adjust the input impedance thereof. However, the chip antenna with a flat metal line does not substantially decrease the size or enhance the efficiency thereof.

2. Taiwan Patent No. 419857:

The patent discloses a surface adhered antenna. This type of antenna also follows the design principle of microline antennas. The lines of the input port and the radiation port are not connected to each other, and the input impedance of the antenna is adjusted by the induction coupling between their conductive lines, thus enhancing the performance of the antenna.

However, the radiation line of the antenna is a simple, flat, meandered line, such as a simple L-shaped or U-shaped meandered line, which cannot effectively decrease the size of the antenna. Moreover, the antenna is a single meandered line with one single input port, the frequency band and bandwidth of which have a poor performance, and the antenna cannot be designed for antenna patterns with different polarizing directions. The applications of the antenna are thus restricted and cannot match varied situations.

3. Taiwan Patent No. 480773:

The patent discloses a chip meandered-lines antenna with multiple substrates. This type of antenna is a three-dimensional antenna structure, and the manufacturing method thereof uses a low temperature cofired ceramic (LTCC) process to manufacture the ceramic substrates.

The ceramic material can be used to minimize the size of the antenna due to its high dielectric constant, but the LTCC process is very complicated. The radiation line of the antenna includes conductive powders positioned on green taps of the ceramic substrates by screen printing, and perforations are created on the ends of the corresponding lines on the adjacent substrates. Conductive materials are used to connect the lines on the upper and lower substrates, thus forming the required three-dimensional antenna structure. Finally, the three-dimensional antenna structure and the ceramic substrates are integrated into a single element by the LTCC process (at about 800° C.–900° C.).

This line design of the type of antenna is based on flat, meandered lines. Several ceramic substrates having flat, meandered lines are prepared. The flat, meandered lines are then connected by perforating holes and electroplating the conductive material to fill them on the ceramic substrates, to form the three-dimensional line. Therefore, the three-dimensional antenna is composed of several flat, meandered lines, and is not easily designed for antenna patterns having a polarizing direction perpendicular to the substrate. In addition, the dielectric constant of the ceramic material usually is limited due to very few materials being suitable for the LTCC process, and the prior art therefore cannot use a ceramic material with a suitable dielectric constant according to different characteristic requirements.

4. Taiwan Patent No. 495106:

The patent discloses a chip antenna, which also is a three-dimensional antenna structure, and is manufactured by the above-described, complicated LTCC process. Several ceramic substrates having flat, meandered lines are prepared. The flat, meandered lines are then connected by perforating holes and electroplating the conductive material to fill them on the ceramic substrates, to form the three-dimensional line. But the line design of the patent is different from that of the former patent. The line design of the former patent is formed by connecting flat, meandered lines on several layers. The line design of this patent is a three-dimensional spiral line, in which conductive lines on every layer are connected to form the three-dimensional spiral structure. But, in whole, the chip antenna of this patent still is a single, meandered line having one single input port.

This type of antenna has the same problems as the antenna of the former patent. Because the LTCC process is applied, the manufacturing method of the antenna is very complicated and the cost thereof is also very high. Moreover, the dielectric constant of the ceramic material usually is limited due to very few materials being suitable to the LTCC process, and the prior art therefore cannot choose the ceramic material with a suitable dielectric constant according to different characteristic requirements. In addition, the three-dimensional antenna is a horizontal and spiral antenna, and therefore it is not easily designed for the antenna patterns having polarizing direction perpendicular to the substrate.

SUMMARY

The conventional chip antennas function inefficiently. Moreover, the manufacturing process of the LTCC process is complicated and the cost thereof is very high, whose main drawbacks are the limited choices of the materials of conductive lines and ceramic substrate caused by the requirement of cofiring procedures, and the possible deformation of meandered lines caused by the sintered shrinkage of the ceramic substrates. Similar to those encountered in the complicated LTCC process, the drawbacks of most commercial chip antenna include high manufacturing cost, low freedom for radiation line design, long period and high cost for developing a product, and inefficient production.

It is therefore an objective of the present invention to provide a chip antenna, in which multiple meandered lines are designed with a single feed, which are folded into a three-dimensional antenna structure, to enhance the freedom of design and the performance of the three-dimensional antenna.

It is another objective of the present invention to provide a chip antenna, in which the composite of a polymer and ceramic material encloses the meandered lines of the antenna body, to mitigate the firing shrinking of the ceramic substrate as well as the deformation of the lines during the prior LTCC process.

It is still another objective of the present invention to provide a method for manufacturing a chip antenna, in which the meandered lines were formed by a continuous punching process to form a flat or three-dimensional antenna structure, and subsequently the composite of a polymer and dielectric ceramic powders was infiltrated or injected to enclose the meandered lines, thus effectively enhancing the performance of the chip antenna and reducing the manufacturing cost thereof.

In accordance with the foregoing and other objectives of the present invention, a chip antenna is provided. The chip antenna comprises an antenna body and a package. The chip antenna has multiple meandered lines with a single feed. The package encapsulates the antenna body, with the packaging material be composed of polymer and ceramic powders, thus having a designed dielectric constant. The structure of the antenna body and the designed dielectric constant determines characteristics of the chip antenna, to satisfy the application characteristic requirements of the chip antenna.

To manufacture the invention, an antenna body with a flat antenna structure is formed by continuously punching or etching an electrically conducting metallic sheet. Moreover, the antenna body can be folded by a punching procedure so as to form an antenna body with a three-dimensional antenna structure.

In another aspect, the packaging of the invention, which encloses the antenna body, is also different from prior arts. The packaging of the invention comprises a polymer and ceramic powders, thus simplifying the manufacturing processes and reducing the cost thereof. Moreover, the selection of the polymer and the ceramic powders is diverse, and the filler's loading can be varied to obtain the required dielectric constant, which satisfies the characteristic requirements, minimizes the size and enhances the performance of the chip antenna.

According to preferred embodiments of the invention, the multiple meandered lines are composed of a conductive material, such as copper, and are electrically connected and fold to form a three-dimensional antenna structure. The packaging material is a composite of polymer and ceramic powders, and the package is formed by infiltration, or injection molding.

The meandered lines are arranged in at least one first direction and electrically connected in the second direction to form at least one meandered line set, and the meandered line set can be folded in the third direction to form a three-dimensional antenna structure. Moreover, when the chip antenna comprises multiple meandered line sets, the meandered line sets are electrically connected in series, or in parallel, or partially in series and partially in parallel, and have a single common feed. In addition, according to another preferred embodiment of the invention, the meandered lines are electrically connected to form a flat antenna structure.

The invention designs the antenna structure as a horizontal antenna structure to satisfy the requirement for a thin antenna module, or designs the antenna structure as a vertical antenna structure to satisfy the requirement for a small antenna module. The antenna of the invention has the characteristics of having multiple meandered lines connected to a single feed, and having the multiple meandered lines being arranged in a three-dimensional structure, thus increasing the bandwidth and improving the antenna radiation patterns of the antenna, as well as providing the capability for multiple frequencies. Furthermore the invention reduces the area occupied by the antenna on the circuit board, decreases the coupling interferences with other adjacent elements, and also raises the freedom of design for multiple frequencies of the antenna.

Additionally, the invention provides great flexibility and variety of antenna product design, and increases the adaptability in handling problems of manufacturers for market responses and requirements. The manufacturers therefore raise the competitiveness of the products by the invention, the characteristics of which are easily changed according to current trends and the market responses.

It is to be understood that both the foregoing general description and the following detailed description are examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings, where:

DESCRIPTION OF THE PREFERRED EMBODIMENTS

Figure 1A:
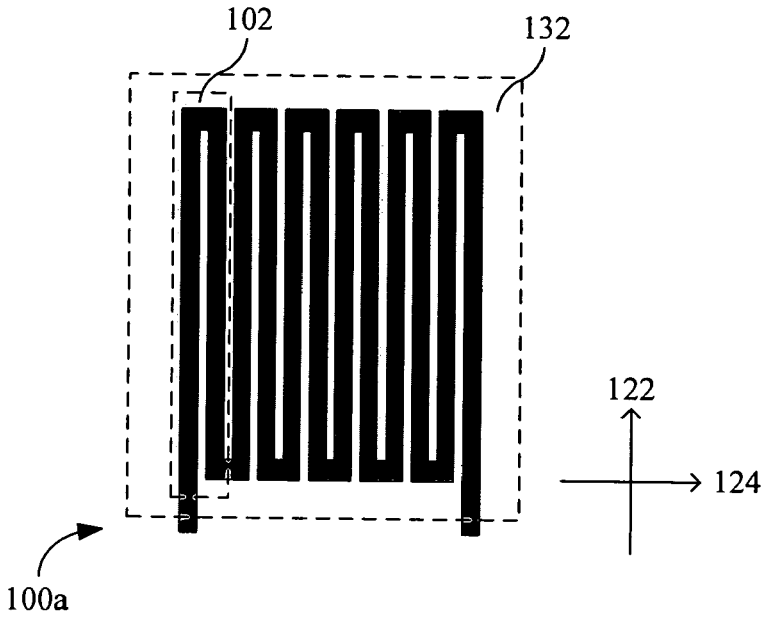
FIG. 1A illustrates a schematic view of a flat antenna body of the first embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

An antenna body is enclosed in a packaging material comprising a polymer and ceramic powders to form a chip antenna. Meandered lines are formed by continuously punching or etching a metallic sheet, which are either further folded or not, and then are packed with the composite material. The kinds and the quantities of the ceramic powders and the polymer of the packaging material are adjustable to change the dielectric constant of the packaging material, which thus raises the flexibility of product design. Therefore, the chip antenna increases the bandwidth and optimizes the antenna patterns of the antenna, and also improves efficiency and lowers the cost of the manufacturing process.

The first and second embodiments explain how the flat antenna bodies form different three-dimensional antenna bodies by folding in different folding manners.

Figure 1B:
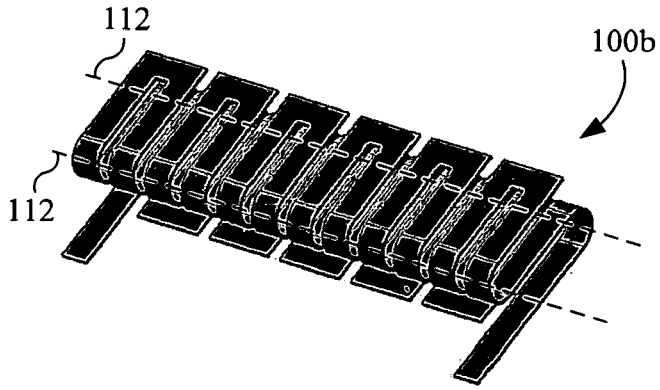
FIG. 1B illustrates a schematic view of a three-dimensional antenna body formed by folding the flat antenna body in FIG. 1A.

The First Embodiment:

FIG. 1A illustrates a schematic view of a flat antenna body of the first embodiment of the invention, and FIG. 1B illustrates a schematic view of a three-dimensional antenna body formed by folding the flat antenna body in FIG. 1A. As illustrated in FIG. 1A, a flat antenna body 100*a* comprises multiple meandered lines 102 arranged in a direction 124, and the meandered lines 102 are electrically connected in series to form a meandered line set 132. The meandered line set 132 can be formed by punching a conductive sheet, such as continuously punching a copper sheet, or by etching a conductive sheet.

Next, the meandered line set 132 is folded in a direction perpendicular to the direction 124, i.e. the direction 122. As illustrated in FIG. 1B, the meandered line set 132 is folded with respect to a folding line 112, thus forming a three-dimensional antenna body 100*b*. The three-dimensional antenna body 100*b* is a horizontal antenna structure, which is thin, thus satisfying the requirement for a thin antenna module.

The Second Embodiment:

The second embodiment explains another three-dimensional antenna body, in which the folding direction thereof is different from that of the first embodiment.

Figure 2A:
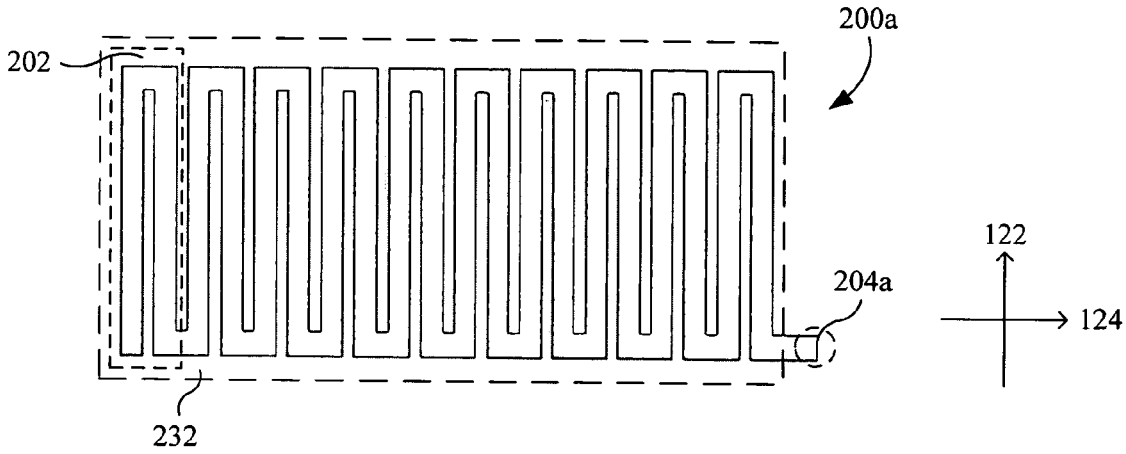
FIG. 2A illustrates a schematic view of a flat antenna body of the second embodiment of the invention.
Figure 2B:
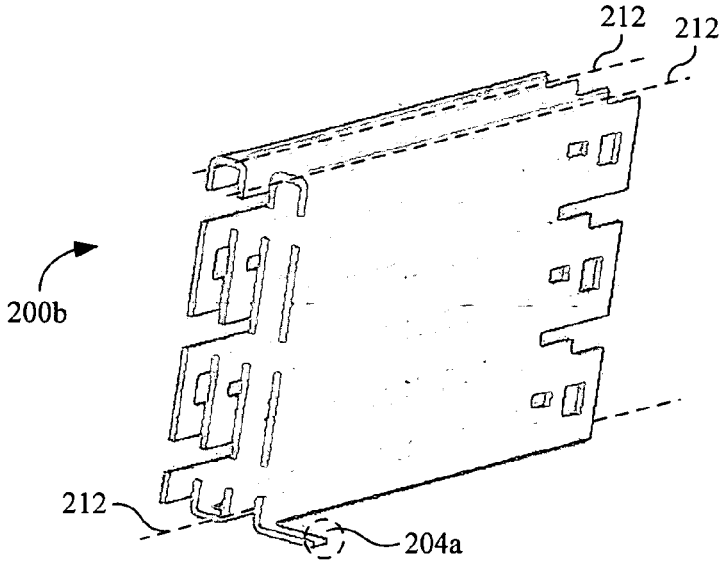
FIG. 2B illustrates a schematic view of a three-dimensional antenna body formed by folding the flat antenna body in FIG. 2A.
Figure 2C:
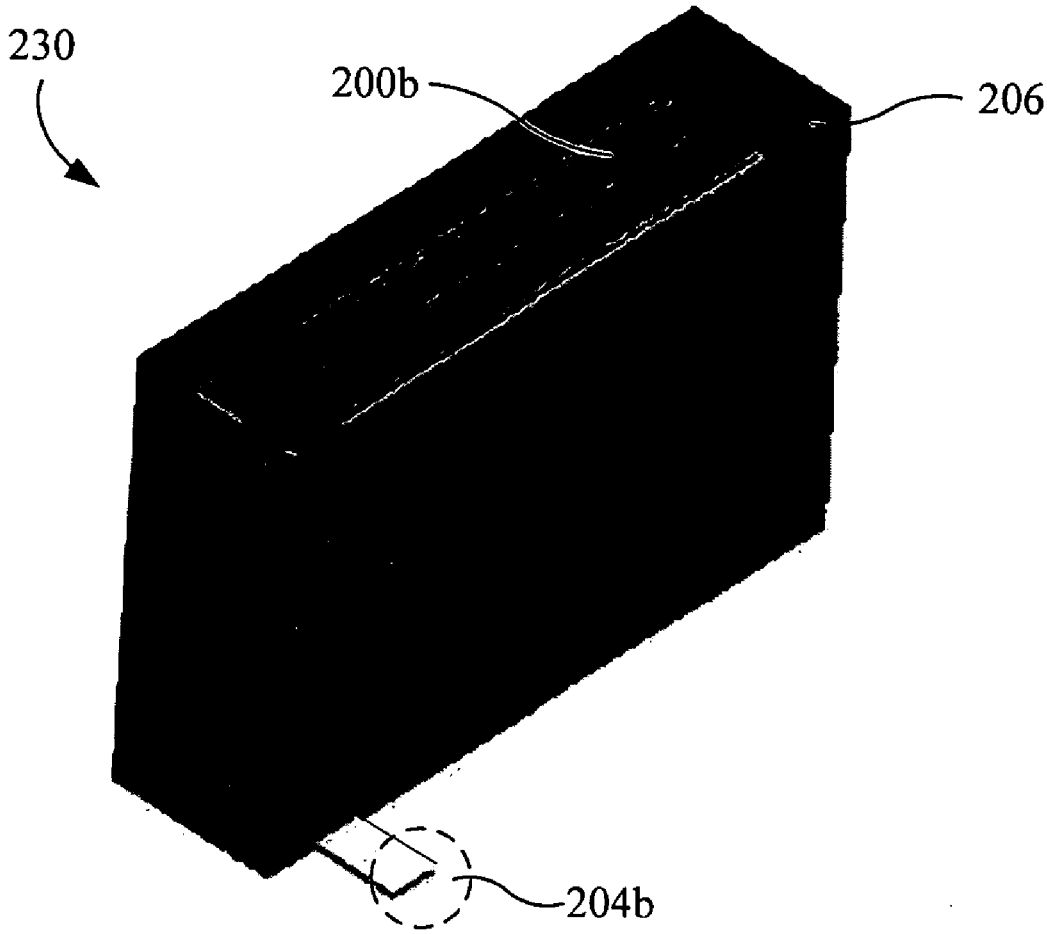
FIG. 2C illustrates a schematic view of a chip antenna formed by encapsulating the three-dimensional antenna body in FIG. 2B with a packaging material.

FIG. 2A illustrates a schematic view of a flat antenna body of the second embodiment of the invention, FIG. 2B illustrates a schematic view of a three-dimensional antenna body formed by folding the flat antenna body in FIG. 2A, and FIG. 2C illustrates a schematic view of a chip antenna formed by encapsulating the three-dimensional antenna body in FIG. 2B in a packaging material.

As illustrated in FIG. 2A, a flat antenna body 200*a* comprises multiple meandered lines 202 arranged in a direction 124, and the meandered lines 202 are electrically connected in series to form a meandered line set 232.

The major difference between the first and the second embodiments is their folding directions of their meandered lines, and thus, their radiating properties. In the second embodiment, the meandered line set 232 is punched and folded in the direction 124. As illustrated in FIG. 2B, the meandered line set 232 is folded with respect to a folding line 212, thus forming a three-dimensional antenna body 200*b*. The three-dimensional antenna body 200*b* is a vertical antenna structure, thus satisfying the requirement for a small antenna module.

Finally, a composite material having a designed dielectric constant, which is, for example, a polymer mixed with ceramic powders in this embodiment, is used to form a package 206 to encapsulate the three-dimensional antenna body 200*b*, thus completing a chip antenna 230. The package 206 is formed by infiltration or injection molding.

The manufacturing process of the embodiment is different from the LTCC process used for manufacturing the conventional chip antenna. The antenna structure of the conventional chip antenna is formed by forming lines on the ceramic green taps by screen printing or photolithography, and then performing the LTCC process. The firing of the ceramic green taps generates volume reduction so as to increase the possibility of the lines being deformed, and is not easily controlled. Additionally, the feed to meandered lines of the conventional chip antenna can be made only on the surface of the antenna.

The manufacturing process of the embodiment is totally different from the prior arts. The antenna body of the embodiment is formed by punching or etching, and the dimensions of the meandered lines is easily controlled and the manufacturing cost is reduced. The antenna body is encapsulated directly in the embodiment, without shrinkage and deformation caused by the firing process used in the conventional LTCC process. Furthermore, as illustrated in FIGS. 2A and 2B, an feed line 204*a* can be preserved while punching the meandered line set 232 and the subsequent three-dimensional antenna body 200*b*. The feed line 204*a* is then processed to be a lead 204*b* of the chip antenna 230. Hence, the lead of the chip antenna of the embodiment is easily manufactured.

The Third Embodiment:

The third embodiment describes an antenna body with different sets of meandered lines. The meandered lines of different sets can be applied with different folding manners, such as folding lengths and angles, to form a three-dimensional antenna body.

Figure 3A:
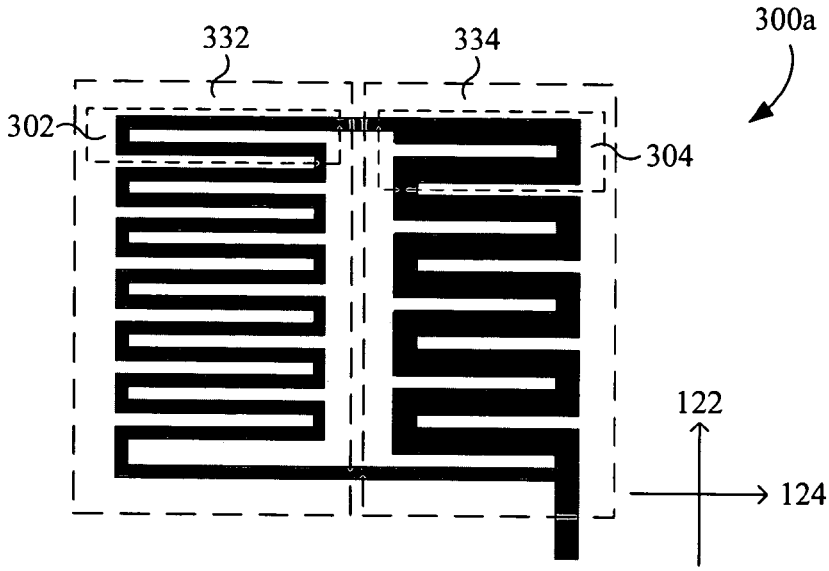
FIG. 3A illustrates a schematic view of a flat antenna body of the third embodiment of the invention.
Figure 3B:
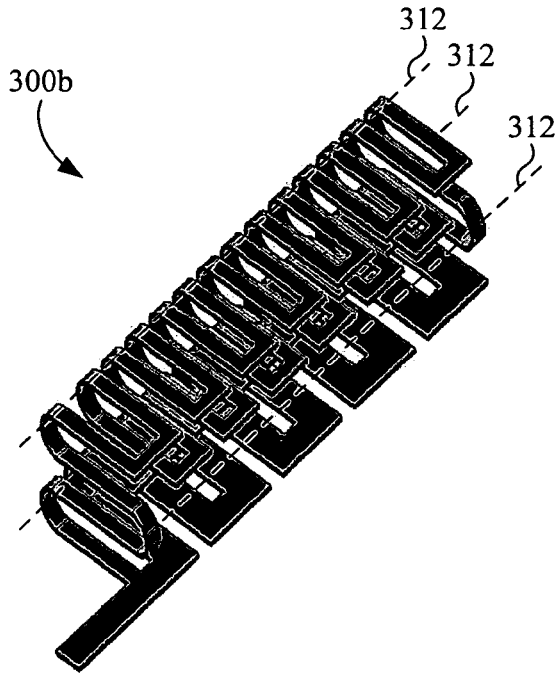
FIG. 3B illustrates a schematic view of a three-dimensional antenna body formed by folding the flat antenna body in FIG. 3A.

FIG. 3A illustrates a schematic view of a flat antenna body of the third embodiment of the invention, and FIG. 3B illustrates a schematic view of a three-dimensional antenna body formed by folding the flat antenna body in FIG. 3A. As illustrated in FIG. 3A, a plurality of the first meandered lines 302 are arranged in a direction 122, and the first meandered lines 302 are electrically connected in series to form a first meandered line set 332. A plurality of the second meandered lines 304 are arranged in a direction 122, and the second meandered lines 304 are electrically connected in series to form a second meandered line set 334. The first meandered line set 332 and the second meandered line set 334 are electrically connected in the direction 124 to form a flat antenna body 300*a*.

Next, the flat antenna body 300*a* is punched and folded in the direction 124. As illustrated in FIG. 3B, the flat antenna body 300*a* is folded with respect to a folding line 312, thus forming a three-dimensional antenna body 300*b*. The three-dimensional antenna body 300*b* is a horizontal antenna structure, and the folding lengths of the first and second meandered line sets 332 and 334 may not be the same.

The Fourth Embodiment:

The fourth embodiment illustrates a flat and double meandered antenna body with a long and narrow structure, which is intended to decrease the actual area occupied by the antenna on a circuit board (including the antenna body and needed clearance).

Figure 4A:
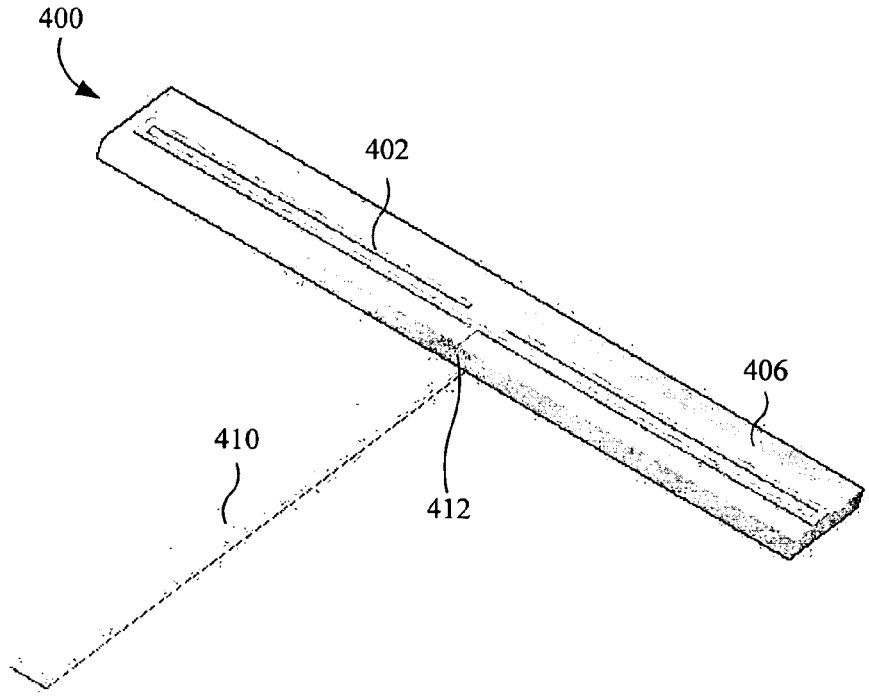
FIG. 4A illustrates a schematic view of the fourth embodiment of the invention.
Figure 4B:
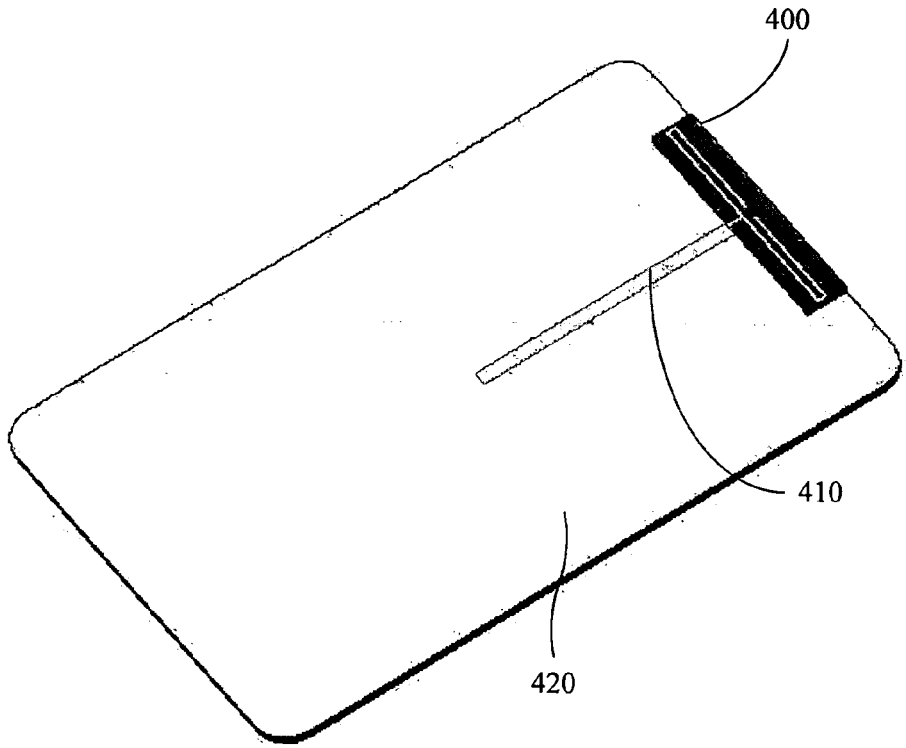
FIG. 4B illustrates a schematic view of the chip antenna of FIG. 4A installed on a circuit board.

FIG. 4A illustrates a schematic view of the fourth embodiment of the invention, and FIG. 4B illustrates a schematic view of the chip antenna of FIG. 4A installed on a circuit board. As illustrated in FIG. 4A, a chip antenna 400 comprises a flat antenna body 402 and a package 406. The flat antenna body 402 has two meandered line sets. As illustrated in FIG. 4B, the chip antenna 400 uses an input port 412 to connect electrically to a transmission microstrip lines 410. The transmission microstrip lines 410 can be electrically connected to the chip antenna 400 and other elements on a circuit board 420. Because the conducting film on the circuit board 420 near the antenna typically need to be etched off, and thus no other elements can be located there, the flat antenna body 402 with the long and narrow structure can decrease the actual area occupied by the antenna on the circuit board 420.

Figure 4C:
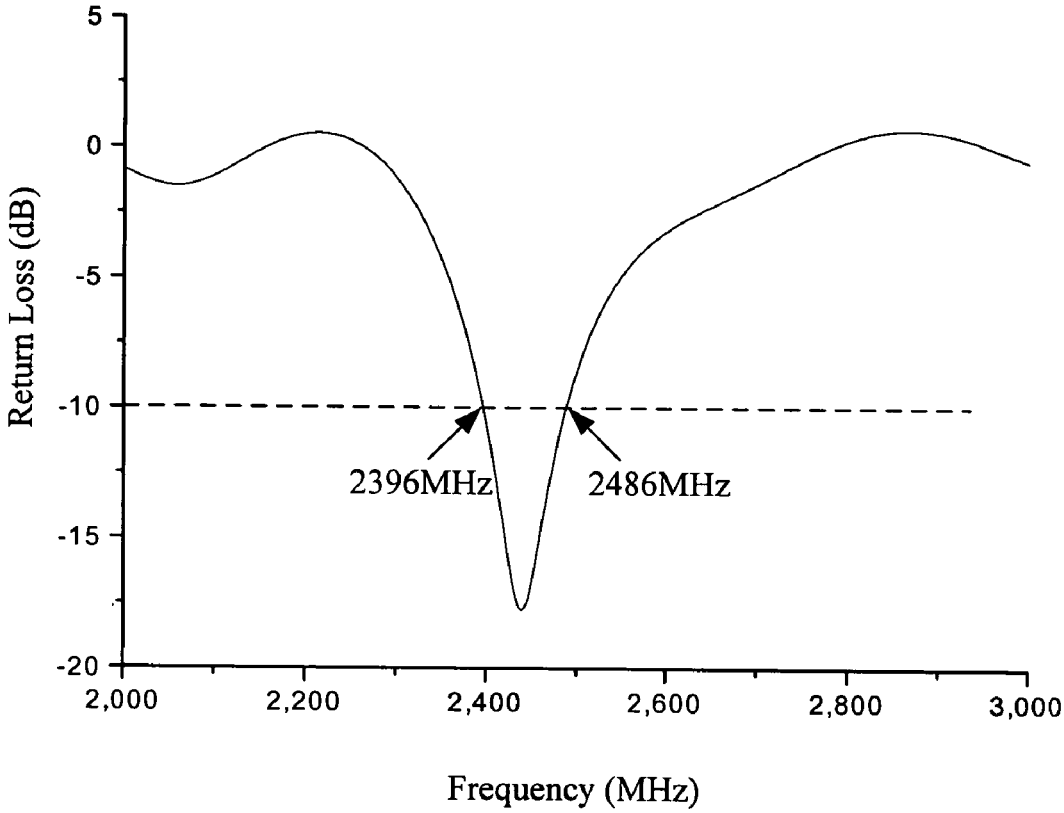
FIG. 4C illustrates a frequency response diagram of return loss of the chip antenna in FIG. 4A.

FIG. 4C illustrates a frequency response diagram of return loss of the chip antenna in FIG. 4A. The x-axis of the diagram represents the return loss of the antenna in dB, and the y-axis of the diagram represents the frequency of the antenna in MHz. In this embodiment, the relative dielectric constant, $\epsilon_r$, of the packaging material 406 is 12. Referring to FIG. 4C, a frequency range of the −10 dB return loss of the chip antenna 400 is between about 2396 MHz and 2486 MHz, and a bandwidth thereof is about 90 MHz, which are suitable for 2.4 GHz ISM wireless communication (e.g. IEEE 802.11b, IEEE 802.11g and Bluetooth communications).

The Fifth Embodiment:

The fifth embodiment explains a three-dimensional chip antenna, in which an antenna body has three meandered line sets, and the three meandered line sets are operated in coordination to satisfy the requirements of large bandwidth and omni-directional antenna patterns.

Figure 5A:
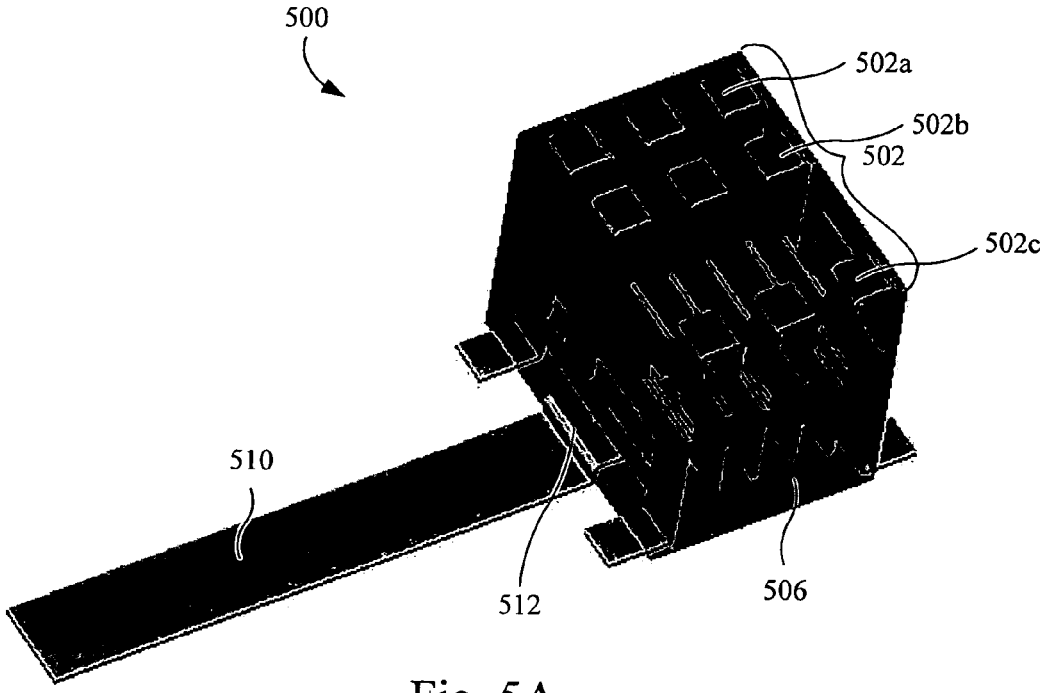
FIG. 5A illustrates a schematic view of the fifth embodiment of the invention.

FIG. 5A is a schematic view of the fifth embodiment of the invention. A chip antenna 500 comprises a three-dimensional antenna body 502 and a package 506. The three-dimensional antenna body 502 has three different meandered line sets 502*a*, 502*b* and 502*c*. The chip antenna 500 uses an feed 512 to connect electrically to a transmission microline 510.

Figure 5B:
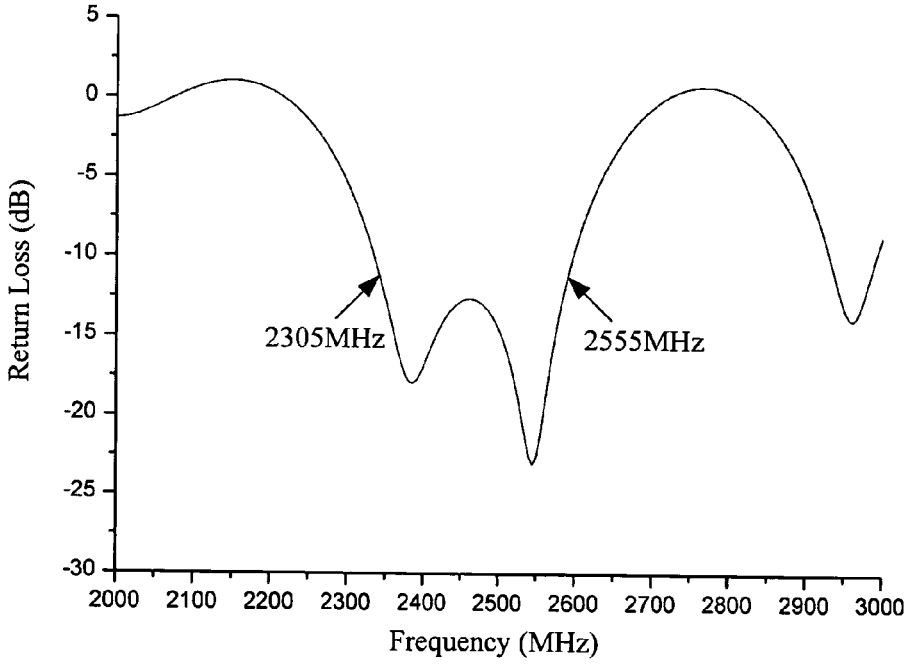
FIG. 5B illustrates a frequency response diagram of return loss of the chip antenna in FIG. 5A.

FIG. 5B illustrates a frequency response diagram of return loss of the chip antenna in FIG. 5A. The x-axis of the diagram represents the return loss of the antenna in dB, and the y-axis of the diagram represents the frequency of the antenna in MHz. In this embodiment, the relative dielectric constant, $\epsilon_r$, of the packaging material 506 is 26, and the area occupied by the chip antenna 500 is less than 25 $mm^2$. Referring to FIG. 5B, a frequency range of the −10 dB return loss of the chip antenna 500 is between about 2305 MHz and 2555 MHz, and a bandwidth thereof is about 250 MHz, which are suitable for 2.4 GHz ISM wireless communication.

The Sixth Embodiment:

The sixth embodiment explains a three-dimensional chip antenna, and an antenna body thereof is assembled with several meandered line sets. Moreover, this embodiment also illustrates that the chip antenna has the function of two frequencies or multiple frequencies.

Figure 6A:
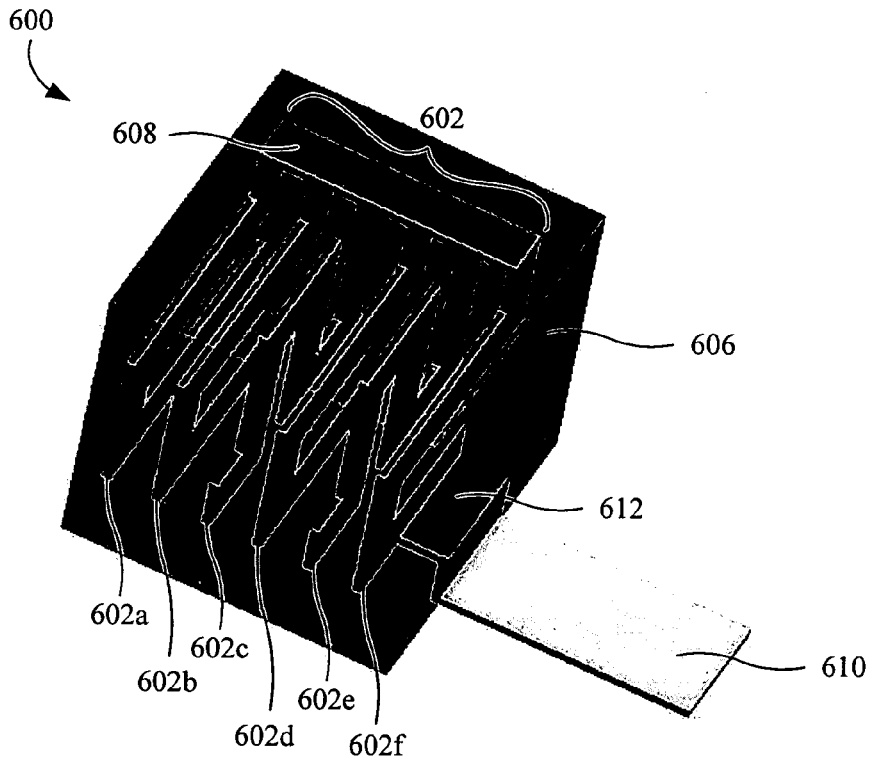
FIG. 6A illustrates a schematic view of the sixth embodiment of the invention.

FIG. 6A is a schematic view of the sixth embodiment of the invention. A chip antenna 600 comprises a three-dimensional antenna body 602 and a packaging material 606. In the three-dimensional antenna body 602, several different meandered line sets 602*a*, 602*b*, 602*c*, 602*d*, 602*e* and 602*f* are electrically connected with a trunk 608. The chip antenna 600 uses a feed 612 to connect electrically to a transmission microline 610.

The meandered line sets 602*a*, 602*b*, 602*c*, 602*d*, 602*e* and 602*f*, besides being formed by punching or etching separately and then electrically connecting to the trunk 608 individually, can be formed integrally as an continuous structure and then electrically connected to the trunk 608. Next, the integrated meandered line sets 602*a*, 602*b*, 602*c*, 602*d*, 602*e* and 602*f* are divided into separated and independent meandered line sets, after being encapsulated with the packaging material 606.

Figure 6B:
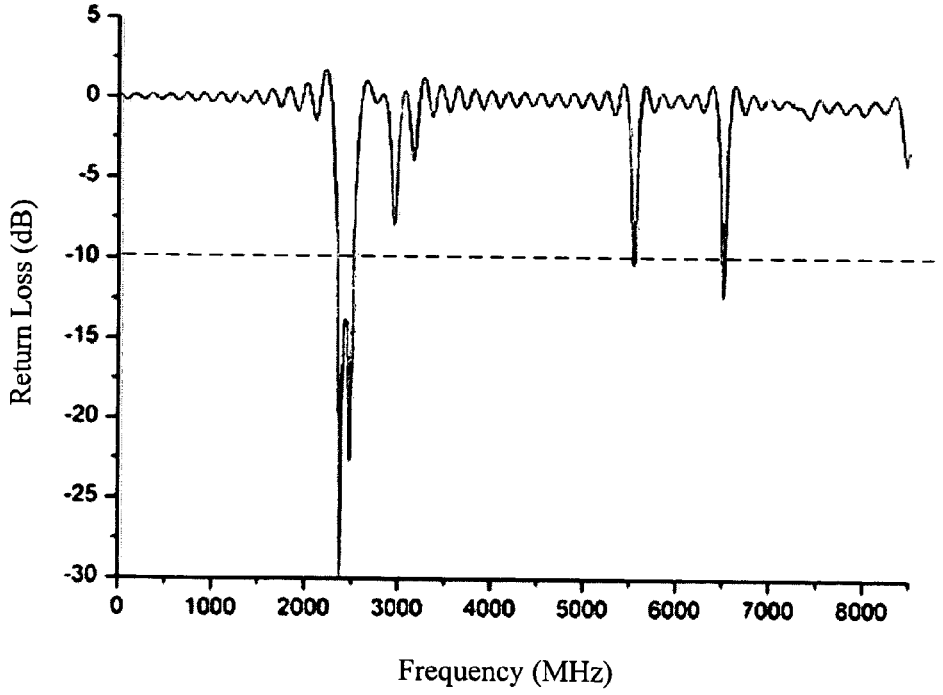
FIG. 6B illustrates a frequency response diagram of return loss of the chip antenna in FIG. 6A.

FIG. 6B illustrates a frequency response diagram of return loss of the chip antenna in FIG. 6A. The x-axis of the diagram represents the return loss of the antenna in dB, and the y-axis of the diagram represents the frequency of the antenna in MHz. In this embodiment, the relative dielectric constant, $\epsilon_r$, of the packaging material 606 is 15, and the area occupied by the chip antenna 600 is less than 12 $mm^2$.

Referring to FIG. 6B, a frequency range of the −10 dB return loss of the chip antenna 600 is between about 2385 MHz and 2590 MHz, and a bandwidth thereof is about 205 MHz, which are suitable for 2.4 GHz ISM wireless communication. The volume of the chip antenna 600 is small, especially suitable for used in the portable wireless communication products. Moreover, a frequency range of the −10 dB return loss of the chip antenna 600, between about 5500 MHz and 6500 MHz, also exists. Therefore, the chip antenna of the embodiment can provide the functions of two frequencies or even multiple frequencies, under proper design.

The chip antenna of the invention, with either a flat antenna body or a three-dimensional antenna body, can have the function of multiple frequencies by varying the structure and parameters of the antenna body, such as line spacing, line width, meandered line type, and dielectric constant of the packaging material. This means that the chip antenna of the invention can have multiple frequency bands, to satisfy the requirement of multiple frequencies.

The Seventh Embodiment:

The seventh embodiment explains a flat chip antenna, in which an antenna body has different meandered line sets electrically connected to each other, and has the function of multiple frequencies.

Figure 7A:
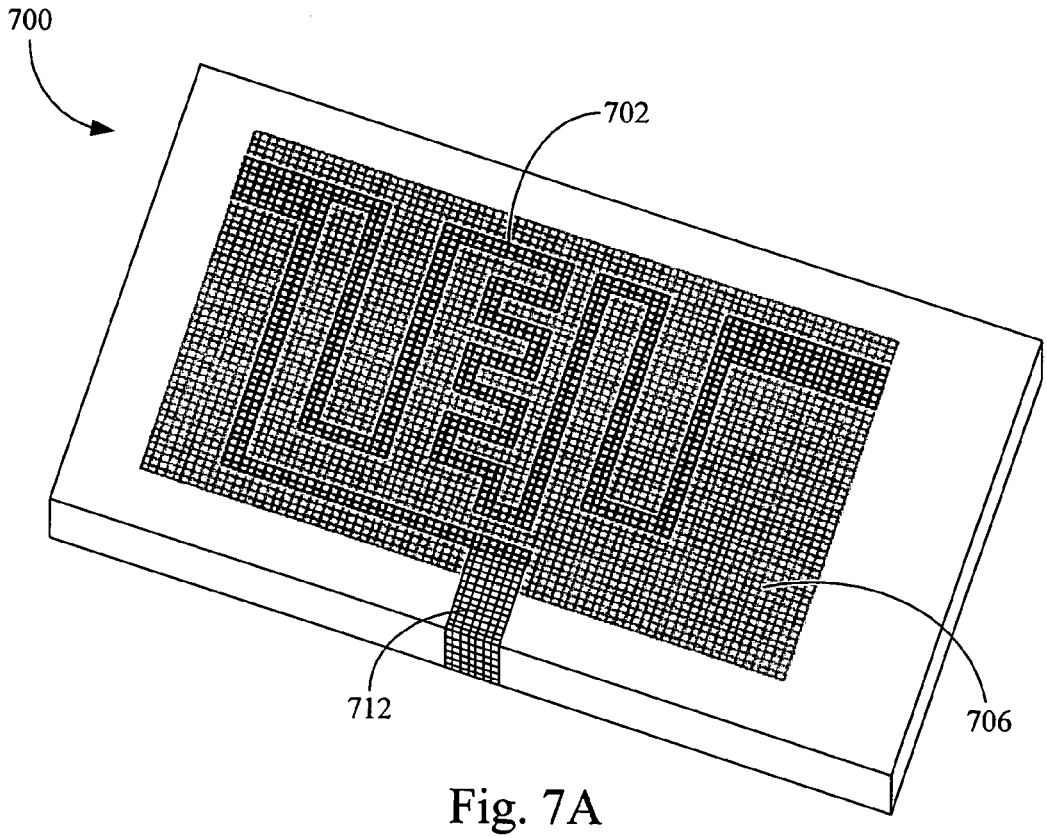
FIG. 7A illustrates a schematic view of the seventh embodiment of the invention.

FIG. 7A is a schematic view of the seventh embodiment of the invention. A chip antenna 700 comprises a flat antenna body 702 and a packaging material 706. The flat antenna body 702 has two different meandered line sets. The chip antenna 700 uses a feed 712 to connect electrically to a circuit board.

Figure 7B:
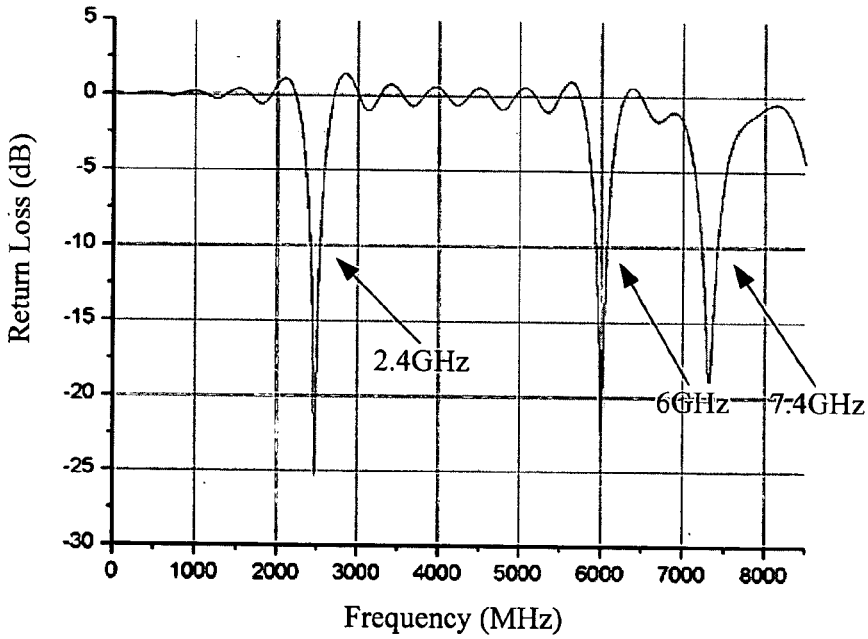
FIG. 7B illustrates a frequency response diagram of return loss of the chip antenna in FIG. 7A.

FIG. 7B illustrates a frequency response diagram of return loss of the chip antenna in FIG. 7A. The x-axis of the diagram represents the return loss of the antenna in dB, and the y-axis of the diagram represents the frequency of the antenna in MHz. As illustrated in FIG. 7B, the chip antenna 700 of the embodiment has less return losses in frequency bands at 2.4 GHz, 6 GHz and 7.4 GHz, and is a flat chip antenna with the function of multiple frequencies.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chip antenna, comprising:

an antenna body, wherein the antenna body comprises multiple meandered lines, the meandered lines are arranged in at least one first direction and electrically connected to form at least one meandered line set, and the meandered line set is folded in at least one second direction to form a three-dimensional antenna structure; and a package, encapsulating the antenna body, wherein the packaging material comprises polymer and ceramic powders, and has a designed dielectric constant;

wherein a structure of the antenna body and the designed dielectric constant determine characteristics of the chip antenna.

2. The chip antenna of claim 1, wherein the chip antenna further comprises a feed, electrically connected to the antenna body.

3. The chip antenna of claim 1, wherein the antenna body comprises multiple meandered lines, and the meandered lines are electrically connected to form a flat antenna structure.

4. The chip antenna of claim 3, wherein the meandered lines are electrically connected in series, or in parallel, or partially in series and partially in parallel.

5. The chip antenna of claim 1, wherein the chip antenna comprises multiple meandered line sets, and the meandered line sets are electrically connected in series, or in parallel, or partially in series and partially in parallel.

6. The chip antenna of claim 1, wherein the first direction is parallel to or perpendicular the second direction.

* * * * *